United States Patent [19]

Mizzi

[11] 4,147,284

[45] Apr. 3, 1979

[54] AIR PROPELLANT-AEROSOL DISPENSER AND COMPRESSOR

[76] Inventor: John V. Mizzi, P.O. Box 455, Old Bedford Rd., Goldens Bridge, N.Y. 10526

[21] Appl. No.: 800,321

[22] Filed: May 25, 1977

[51] Int. Cl.[2] ..... B65D 83/14

[52] U.S. Cl. ..... 222/401; 222/541

[58] Field of Search ..... 222/401, 209, 400.8, 222/541, 389, 386.5, 399

[56] References Cited

U.S. PATENT DOCUMENTS

| | | | |
|---|---|---|---|
| 1,256,870 | 2/1918 | Buck | 222/401 X |
| 2,613,111 | 10/1952 | Freund et al. | 222/401 X |
| 3,099,370 | 7/1963 | Hein | 222/389 X |
| 3,217,936 | 11/1965 | Abplanalp | 222/389 X |
| 3,372,838 | 3/1968 | Smith et al. | 222/399 X |
| 3,403,820 | 10/1968 | Landis et al. | 222/399 X |
| 3,685,680 | 8/1972 | Tenckhoff et al. | 222/541 X |
| 3,995,779 | 12/1976 | Mizzi | 222/401 |

*Primary Examiner*—John P. Shannon

*Attorney, Agent, or Firm*—Albert F. Kronman

[57] ABSTRACT

An aerosol dispenser in which the material to be expelled is carried within a container in communication with a spray nozzle. An air compressor carried by the container supplies compressed air to the container to pressurize the said material. The compressor is operated by the normal vertical shaking of the assembly. The compressor may be carried within the container or attached thereto during use. In one embodiment the container may be refilled. In a second embodiment the container is separable from the compressor and may be discarded after use.

6 Claims, 8 Drawing Figures

FIG. 1
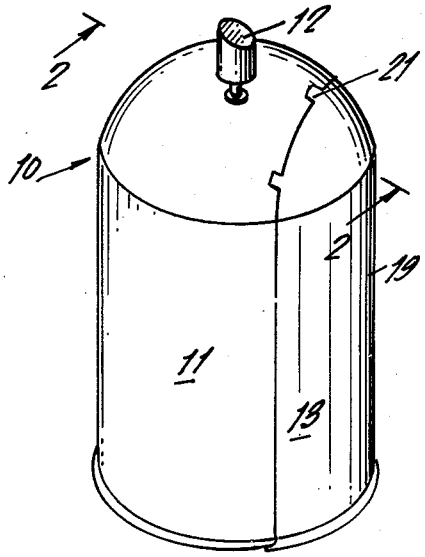
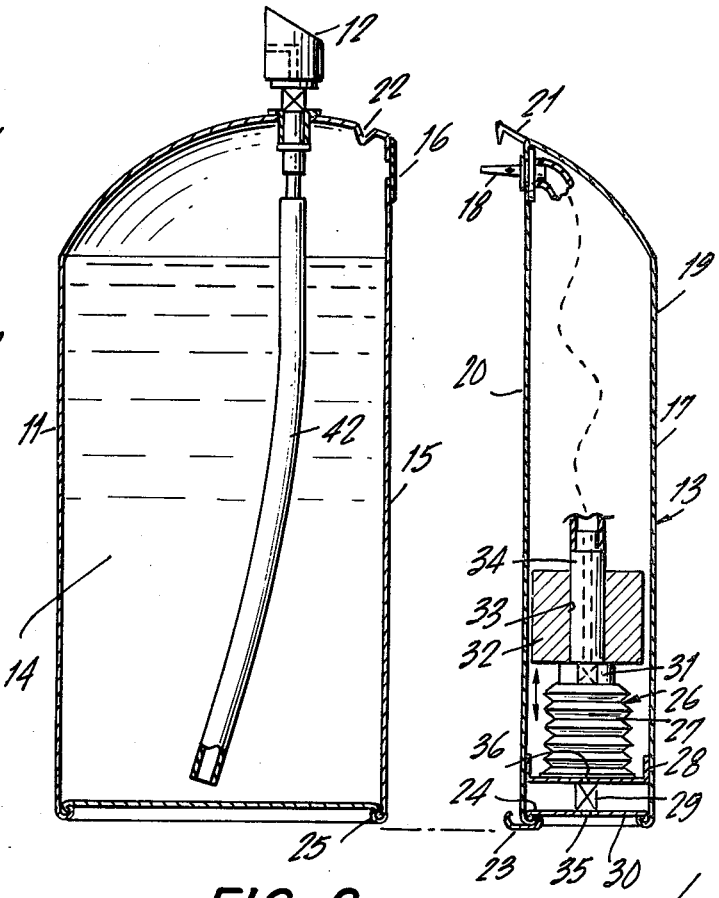
FIG. 2
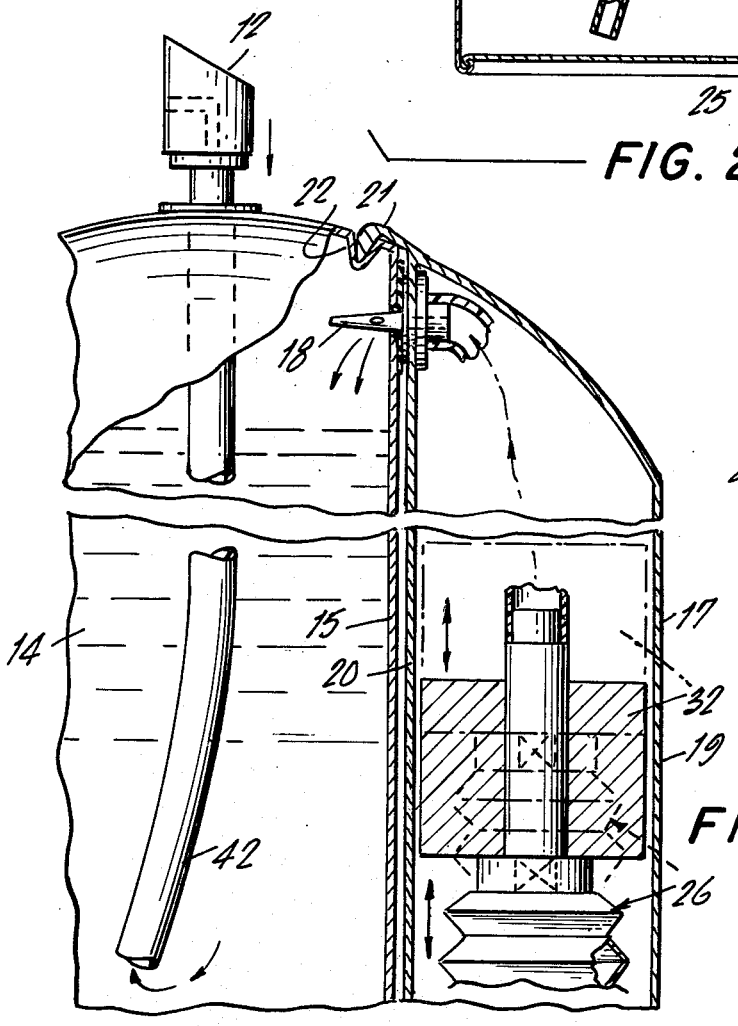
FIG. 3
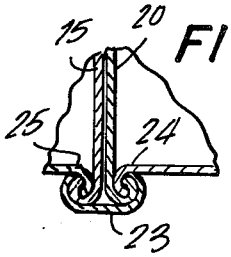
FIG. 4

AIR PROPELLANT-AEROSOL DISPENSER AND COMPRESSOR

BACKGROUND OF THE INVENTION

It has been shown in U.S. Pat. No. 3,995,779 issued Dec. 7, 1976 to John V. Mizzi that a small compressor could be built into an aerosol can to supply compressed air for dispensing a liquid contained within the can. Since the aerosol dispenser market is primarily of the "throw away" or expendable type, the cost of the structure shown in this patent prevents its wide-spread use.

In U.S. Pat. No. 2,982,443 issued May 2, 1961, there is shown a device for dispensing a liquid and semi-solid material from a flexible walled reservoir carried within a rigid container into which air under pressure is led to squeeze the flexible reservoir and force the contents out of a dispensing nozzle. Air is forced into the container by means of a trigger which is squeezed repeatedly by the user. This is not an aerosol dispenser.

A pumping apparatus for an internal combustion engine is disclosed in U.S. Pat. No. 2,645,184 issued July 14, 1953. This patent teaches the use of a piston lightly balanced between springs within a cylinder block. Vibration of the engine causes the piston to pump the fluid into a fuel bowl. Here again, there is no aerosol dispenser suggested.

SUMMARY OF THE INVENTION

It is an object of the present invention to provide an aerosol dispenser which is operated in the same manner as conventional aerosol dispensers without the disadvantages of prior art devices.

Another object of the present invention is to provide a relatively inexpensive aerosol dispenser which is pressurized by the familiar operation of vertical shaking.

A further object of the present invention is to provide an aerosol dispenser which operates at low safe pressures while meeting conventional dispenser requirements.

Still another object of the present invention is to provide an aerosol dispenser which embodies the expendable concept of the aerosol dispenser market.

An object of the present invention is to provide an aerosol dispenser in which the propellant is air supplied by a reusable compressor.

A further object of the present invention is to provide an aerosol dispenser in which the reservoir for the product is refillable.

Other objects and features of the invention will become apparent from the following description and drawings forming part hereof.

In one form of the present invention the material to be dispensed is placed within a reservoir to which there is coupled an air compressor pump module. A small bellows within the pump module is secured at one end to the container for the pump module. The opposite or free end of the bellows supports a weight. A flexible tube is connected at one end to an output valve on the free end of the bellows and at its other end to a needle-like member which extends through the pump container and into an air space above the material to be dispensed. As the entire aerosol dispenser assembly is shaken vertically, the weight operates the bellows bringing air into the bellows through a valve at the fixed end and on the opposite stroke forcing it out of the bellows, through the needle-like member and into the reservoir. Sufficient air pressure is thus built up to form and dispense an aerosol from a valve and nozzle carried by the reservoir.

Another embodiment disclosed herein employs a fluid tight membrane in the reservoir overlying the material to be dispensed to prevent air from coming into contact with the material to be dispensed.

A further embodiment of the present invention provides for an aerosol dispenser in which the air compressor pump module is coaxial with the reservoir and the reservoir reciprocates with certain pump parts as the device is shaken. In this form of the invention, the reservoir is refillable.

BRIEF DESCRIPTION OF THE DRAWINGS

In the accompanying drawings forming part hereof, similar parts have been given the same reference numerals, in which drawings:

FIG. 1 is a somewhat isometric view of one complete embodiment of the present invention.

FIG. 2 is a vertical section somewhat enlarged of the dispenser shown in FIG. 1 taken on line 2—2 in a partly disassembled condition.

FIG. 3 is a fragmentary view similar to FIG. 2 on an enlarged scale in an assembled condition.

FIG. 4 is a fragmentary cross-sectional view of the coupling flange shown in FIG. 2.

DETAILED DESCRIPTION OF THE INVENTION

Figure 5:
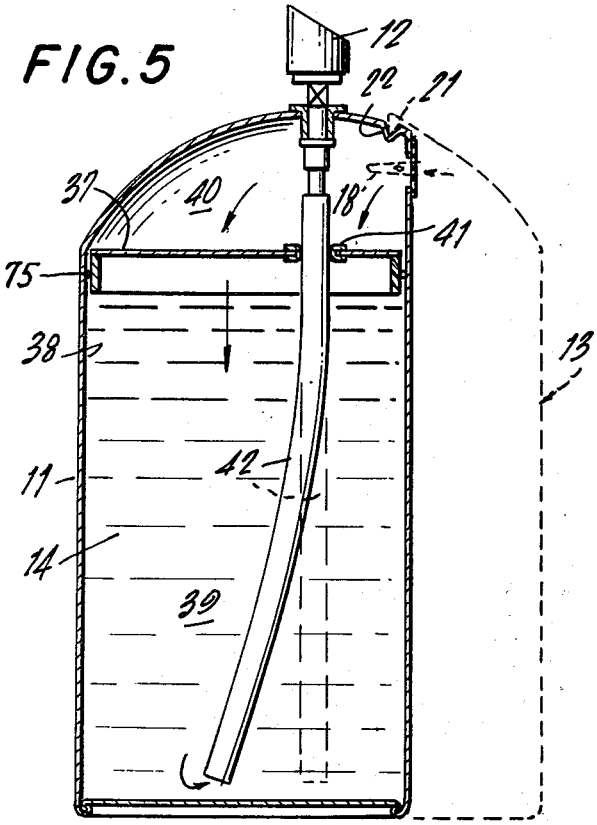
FIG. 5 is a vertical cross-sectional view of a second embodiment of the present invention.

Referring to the drawings and particularly FIGS. 1-4, 10 indicates an aerosol dispenser made in accordance with the present invention having a reservoir 11. A dispensing nozzle 12 is carried at the top of the reservoir and an air compressing pump module 13 is removably secured to the reservoir. As best shown in FIGS. 1 and 2, a quantity of liquid 14 or other material to be dispensed is placed within the reservoir 11. One portion of the reservoir wall 15 is flattened to provide a bearing surface to receive the air compressing pump module 13. The flattened wall 15 is also provided with an elastomeric seal 16.

From an examination of FIGS. 2 and 3 it will be seen that the air compressing pump module consists of a container 17 having a needle-like member 18 projecting therefrom. The container 17 is also preferably made with a curved wall 19 and a flattened wall 20 which is complementary to the wall 15 of the reservoir.

The upper portion of the container 17 is formed with a series of extending latches 21 which are adapted to engage recesses 22 adjacent the flattened wall 15 of the reservoir 11. A flange member 23 is carried at the bottom of the container 17 and is secured to a bead 24 at the bottom thereof. The flange 23 extends in the direction of the reservoir 11 and engages a bead 25 in the manner shown in FIG. 4 to couple the air compressing pump module 13 to the reservoir 11. See FIGS. 1-3. As the coupling is effected, the needle-like member 18 will puncture the elastomer seal 16 thereby placing the interior of the pump module 13 in communication with the interior of the reservoir 11.

A pump 26 within the air compressing pump module includes a bellows 27 secured at one end to a wall 28 carried within and adjacent to the bottom of the container 17. A small valve 29 is secured at one end to the bottom 30 of the container 17 and to the wall 28 at its other end. The valve 29 is in communication with ambient atmosphere through an opening 35 in the container bottom 30. A second opening 36 in the wall 28 places the valve 29 in communication with the interior of the bellows 27.

A second valve 31 which may be a flap valve is secured at one end to the free end of the bellows 27 and at its other end to a weight 32. The weight 32 is slidably carried within the container 17 and is axially bored as indicated at 33. The valve 31 permits air to pass from the bellows 27 into the bore 33.

As shown in FIG. 2, a flexible tube 34 is carried within the bore 33 and cemented or otherwise secured thereto. The opposite end of tube 34 is connected to the nozzle 18. It will be apparent from the foregoing that as the air compressing module is swung downwardly, the inertia of the weight 32 will cause the bellows 27 to be expanded axially as indicated in dashed lines in FIG. 3. Air will be drawn into the bellows through the valve 29. When the downward motion of the container 17 stops and an upward direction is imparted to it, as in vertical shaking, the weight 32 will be forced downwardly against the bellows thereby compressing it. The air in the bellows will be forced through the valve 31 up the flexible tube 34 and out of the nozzle 18.

When the apparatus is assembled as shown in FIGS. 1 and 3, the air coming through the nozzle 18 will be forced into the reservoir 11 above the liquid 14 contained therein. When sufficient air pressure has been achieved by reason of shaking the assembly, the dispensing nozzle 12 may be pressed in the conventional manner, liquid will be forced up the dip tube 42 and a fine aerosol will be expelled from the nozzle. When air pressure drops within the reservoir 11, it is only necessary to resume the familiar shaking motion to build up sufficient air pressure to resume application of the liquid 14.

In the embodiment shown in FIGS. 1–4, the reservoir 11 may be an expandable or throw away item. The air compressing pump module may be used many times for dispensing purposes. It has been found that pressures up to 10 psi can be achieved within the reservoir 11 by the application of 4 to 5 shaking strokes. This pressure is adequate for dispensing many liquids such as paint, insecticides, cosmetics, etc.

Figure 6:
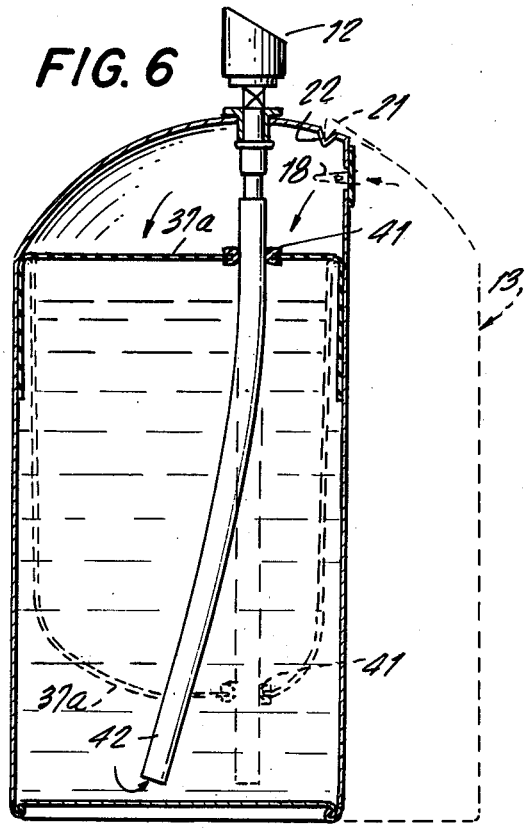
FIG. 6 is a view similar to FIG. 5 indicating in dashed lines certain operative parts.

It will be apparent to those skilled in the art that a wide variety of discharge nozzles presently available may be selected to be compatible to the contents to be dispensed and the nature of the aerosol to be produced.

Where it is desired to protect the material to be dispensed from coming into contact with air, the embodiments shown in FIGS. 5 and 6 may be employed. In FIG. 5 there is shown a rigid diaphragm 37 secured to a ring which is slidable within the reservoir 11. "O" rings 75 carried by the diaphragm ring seal the liquid chamber 39 from the air chamber 40. As the liquid 14 is used up the air pressure in the chamber 40 forces the diaphragm 37 downwardly acting as a barrier between the surface of the liquid 14 and the air in the chamber 40.

The dip tube 42 which leads the liquid 14 up to the dispensing valve 12 is slidably led through the gasket 41 carried by the diaphragm 37.

In the embodiment shown in FIG. 6 the reservoir is provided with an elastomer diaphragm 37*a* which is bonded to the inner wall 38 of the reservoir. The diaphragm 37*a* overlies the liquid 14 within the reservoir 11 and divides the area within the reservoir 11 into a liquid containing chamber 39 and an air receiving chamber 40. A ring shaped gasket 41 is slidably received upon the elongated dip tube 42 through which the liquid 14 is led up to the nozzle 12. The gasket 41 is carried by the diaphragm 37*a* as shown in FIGS. 5 and 6 to form a fluid tight closure around the tube 42.

As the liquid 14 within the reservoir 11 becomes depleted the diaphragm 37*a* will be forced downwardly from the position shown in FIG. 5 to that shown in dashed lines at 43 in FIG. 6. It will be apparent that the air within the chamber 40 is thus prevented from coming in contact with the surface of the liquid 14.

Figure 7:
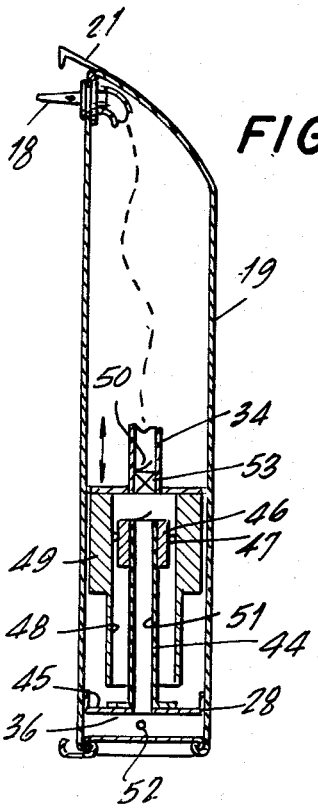
FIG. 7 is a view in vertical section of another air compressing assembly useful with the structure shown in FIGS. 1-6.

In FIG. 7 there is shown another pump structure suitable for use in the present invention. In this embodiment an upstanding hollow piston rod 44 is secured at its lower end to the wall 28 by means of flanges 45. A small piston 46 is secured to the top of the rod 44 and provided with an O ring 47 to form a seal with the inner wall 48 of a combined weight and cylinder structure 49. A small flap valve 50 or other suitable valve is carried at the top of the rod 44 and overlies the bore 51 thereof. The bottom of the rod 44 communicates with the opening 36 in the wall 28 and ambient air is brought into the container 18 beneath the opening 36 by means of a suitable apperature 52 in the wall of the container.

The flexible tube 34 is secured to a second flap valve 53 which in turn is connected to the top of the combined weight and cylinder member 49.

The operation of this embodiment is the same as the other embodiments of the present invention, namely, that as vertical shaking motion is imparted, the weight 49 together with the cylinder member is reciprocated. The cylinder moves with respect to the piston 46 and the flap valves 50, 53 operate to bring air into the cylinder and, thereafter, force it up the flexible tube 34 and through the needle like member 18 into the reservoir 11.

Figure 8:
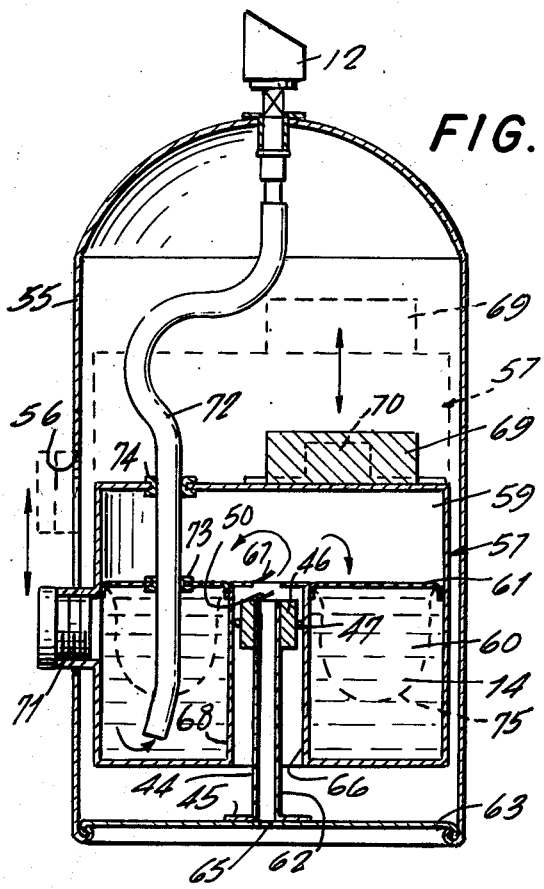
FIG. 8 is another embodiment of the present invention shown in vertical section.

While the preceding embodiments disclose the use of an expendable reservoir unit, it is within the purview of the present invention to provide a structure such as is illustrated in FIG. 8 in which the reservoir may be refilled from time to time as required.

In the embodiment of FIG. 8 there is shown a can shaped housing 55 having an elongated slot 56 inside thereof. A combined pump and reservoir assembly 57 is carried within housing 55 and is actuated by vertical shaking. The pump and reservoir assembly consists of a compartment 58 divided into a first and second chamber 59, 60 by a wall 61. The first chamber 59 receives air which is compressed by the pump mechanism 62. The pump mechanism 62 is similar to that illustrated in FIG. 7 and consists of an elongated sleeve 44, having flanges 45 which are secured to the bottom 63 of the housing 55. The sleeve 44 is provided with a piston 46 having a O ring 47 thereon. The lower end of the sleeve 44 is in communication with ambient air through an opening 65 in the housing bottom 63. The upper end of the sleeve is provided with a valve 50 which permits air to enter the cylinder 66 of the pump above the piston 46 but prevents it from leaving the cylinder except by way of valve 67 as the cylinder 66 moves with respect to the piston 46.

It will be seen from an examination of FIG. 8 that cylinder 66 is formed by an axial ring 68 incorporated into the second chamber 60 which is thereby in the form of a hollow ring.

If desired, and in order to give the combined pump reservoir and assembly sufficient inertia when the liquid 14 or other material to be dispensed in partially depleted, a small weight 69 may be added to the top of the pump and reservoir assembly and secured in place by clips 70. The second chamber 60 which receives the liquid 14 is provided with the laterally extending fitting 71 in communication with the interior of said second chamber. The fitting 71 may be threaded to receive a fluid tight cap thereon (not shown) and extends beyond the side of the housing 55 and through the slot 56. In this manner, additional liquid or other material to be dispensed can be added or removed from the chamber 60. A flexible dip tube 72 extends from the liquid in the chamber 60 up through a first and second seal 73, 74 carried in the top of the second and first chamber respectively.

It will be seen from an examination of FIG. 8 that the wall 61 is flexible and preferably made of some suitable elastomeric material such as Neoprene, rubber or the like.

As the contents of the chamber 60 become depleted, the wall 61 will be forced from the position shown in FIG. 8 downwardly into the position shown in dashed lines at 75. The contents within the second chamber 60 will also be forced upwardly through the tube 72 and out of the dispensing nozzle 12.

Many modifications of the apparatus disclosed herein will become apparent to those skilled in the art and are within the purview of the present invention.

As a specific example of a suitable pump mechanism, and not by way of limitation, a pump employing a plastic bellows of a 5/16 inch effective diameter and a one inch stroke can provide a maximum pressure of 10 psi. This low pressure is sufficient, when used together with a nozzle such as one of the mechanical break up or of the two phase type or a combination type, to provide a wide range of applications (including foaming capability).

In the embodiment using a rigid cylinder, a ⅜" cylinder with a one inch stroke of an acrylic piston will provide 10 psi of pressure.

Inertia in both examples is provided by a 6 to 8 oz. weight. The reservoir is of a size no larger than the conventional 11 oz. aerosol can.

The low pressure permits the reservoir 11 to be made of thinner gauge material thereby reducing cost and eliminating the danger of users of presently known highly pressurized aerosol dispensers. Since no space is taken up by a chemical propellant, a greater amount of product can be carried within an 11 oz. can configuration than in conventional aerosol cans of the same volumetric capacity. The reusable features incorporated in the embodiments disclosed herein will result in a savings in materials, the energy to produce the devices, and, therefore, the cost to the consumer.

Having thus fully described the invention, what is claimed and desired to be secured by Letters Patent and claimed is:

1. An aerosol dispenser employing air as the propellant for the product to be expelled comprising a hollow housing having a top, a bottom and side wall, a vertically reciprocable combined pump and reservoir assembly carried within the housing, an elongated slot in the housing side wall, a fitting connected at one end to the reservoir and in communication with the interior thereof, a dispensing valve carried by the housing, a dip tube disposed within the reservoir at one end and connected to the nozzle at its other end, and pump means operatively coupled between the housing and the reservoir.

2. An aerosol dispenser according to claim 1 in which a wall carried within the combined pump and reservoir assembly separates the assembly into an air chamber and a liquid chamber, and the reservoir is in the form of a hollow ring having a cylindrical central part within which the pump means is disposed.

3. An aerosol dispenser according to claim 2 in which the pump means comprises a hollow piston rod secured at one end to the housing bottom in communication with ambient air passing therethrough, a piston carried around the free end of the piston rod and slidable within the cylindrical part of the reservoir and check valve means carried by the piston rod and between the pump and air chamber to control the passage of air therethrough.

4. An aerosol dispenser according to claim 3 in which a weight is secured to the combined pump and reservoir assembly to add inertia thereto.

5. An aerosol dispenser employing air as the propellant for the product to be expelled comprising a hollow reservoir, a fluid tight side wall, top, and bottom in the reservoir to receive a quantity of a product, a fluid tight flexible elastomer diaphragm bonded at its edges to the reservoir side wall dividing the interior of the reservoir into a liquid chamber and an air chamber, a fluid tight gasket carried by the diaphragm, and elastomer seal in the reservoir wall, a product dispensing nozzle carried by the reservoir, a dip tube connected to the nozzle and in communication through the said gasket with the interior of the reservoir and the product, an air compressor operatively and detachably coupled to the reservoir for vertical reciprocation therewith, said compressor including a pump, in said compressor, tubular means and a hollow needle carried by the compressor to lead the air from the pump into the reservoir through the elastomer seal into the air chamber above the product, and valve means between the said pump and the interior of the reservoir to direct the air into the tubular means.

6. An aerosol dispenser employing air as the propellant for the product to be expelled comprising a hollow reservoir comprising a fluid tight sidewall, having a flattened portion thereon, a top, and a bottom, to receive a quantity of a product, an elastomer seal in the flattened portion of the reservoir side wall, a product dispensing nozzle carried by the reservoir, a dip tube connected to the nozzle and in communication with the interior of the reservoir and the product, a container, an air compressor in said container, said container and compressor being operatively and detachably coupled to the flattened portion of the reservoir wall for vertical reciprocation therewith, said compressor including a pump in said compressor, tubular means including a hollow needle adapted to penetrate the elastomer seal to lead the air from the pump into the reservoir above the product, and valve means to direct the air into the tubular means between the said pump and the interior of the reservoir through the elastomer seal, and complementary latching members carried by the reservoir and the compressor container to hold the said reservoir and compressor in cooperative engagement during use.

* * * * *